United States Patent [19]

Possell

[11] 4,347,033

[45] Aug. 31, 1982

[54] CONCRETE PUMP AND METHOD OF USING SAME

[76] Inventor: Clarence R. Possell, 4842 Viane Way, San Diego, Calif. 92110

[21] Appl. No.: 117,642

[22] Filed: Feb. 19, 1980

[51] Int. Cl.[3] ..... F01D 1/36; B65G 53/32

[52] U.S. Cl. ..... 415/90; 415/121 B; 415/201; 417/900

[58] Field of Search ..... 415/90, 121 B, 201, 415/213 A, 219 B, DIG. 4; 417/900; 406/99, 101

[56] References Cited

U.S. PATENT DOCUMENTS

| | | | |
|---|---|---|---|
| 827,296 | 7/1906 | Donnelly | 406/99 |
| 1,061,142 | 5/1913 | Tesla | 415/90 |
| 2,144,417 | 1/1939 | Schneible | 415/219 B |
| 2,245,035 | 6/1941 | Hartman | 415/121 B |
| 2,448,849 | 9/1948 | Wagner et al. | 415/121 B |
| 3,045,428 | 7/1962 | McLean | 415/90 X |
| 3,312,176 | 4/1967 | Hacker | 417/900 |
| 3,692,422 | 9/1972 | Girardier | 415/121 B |
| 3,786,996 | 1/1974 | Richter | 415/121 B |
| 4,025,225 | 5/1977 | Durant | 415/90 |

OTHER PUBLICATIONS

*An Analytical and Experimental Investigation of Multiple Disk Pumps and Compressors,* Rice, W., Journal of Eng. For Power, Jul. 1963.

D. G. Shepherd, Principles of Turbomachinery, The MacMillian Company, 1969, pp. 155, 156.

*Primary Examiner*—Leonard E. Smith

*Attorney, Agent, or Firm*—William C. Babcock

[57] ABSTRACT

A method of transferring flowable concrete containing aggregate to a desired location at substantially constant rate without sharp variations in pressure and a power driven pump that may be used to carry out the method. The pump requires no valves, is highly abrasive resistant, has a high constant flow rate discharge due to not operating intermittently, and subjects the conduit or hose through which the concrete discharges to a minimum of strain as the concrete flows at a substantially constant rate therethrough with no sharp variations in pressure, and with minimum frictional resistance.

13 Claims, 5 Drawing Figures

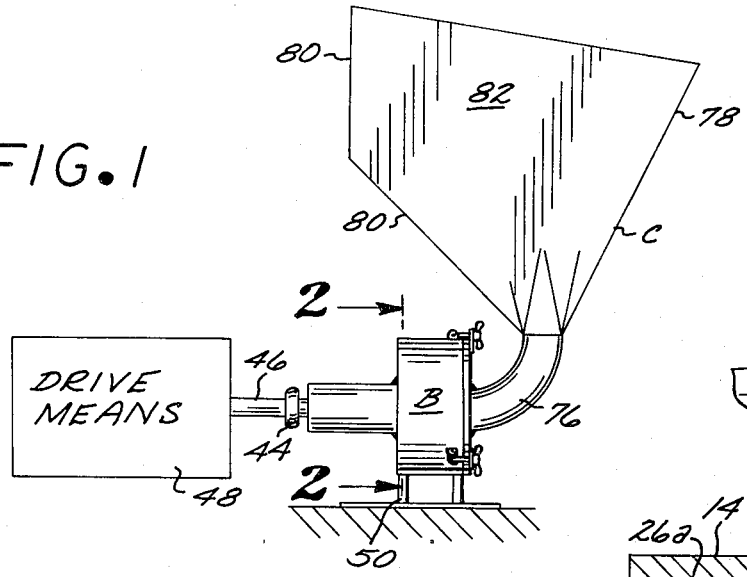
FIG. 1
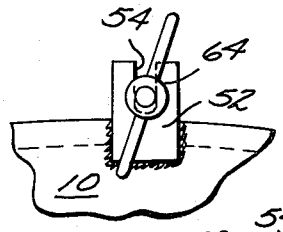
FIG. 4
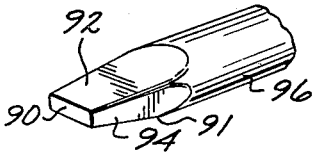
FIG. 5
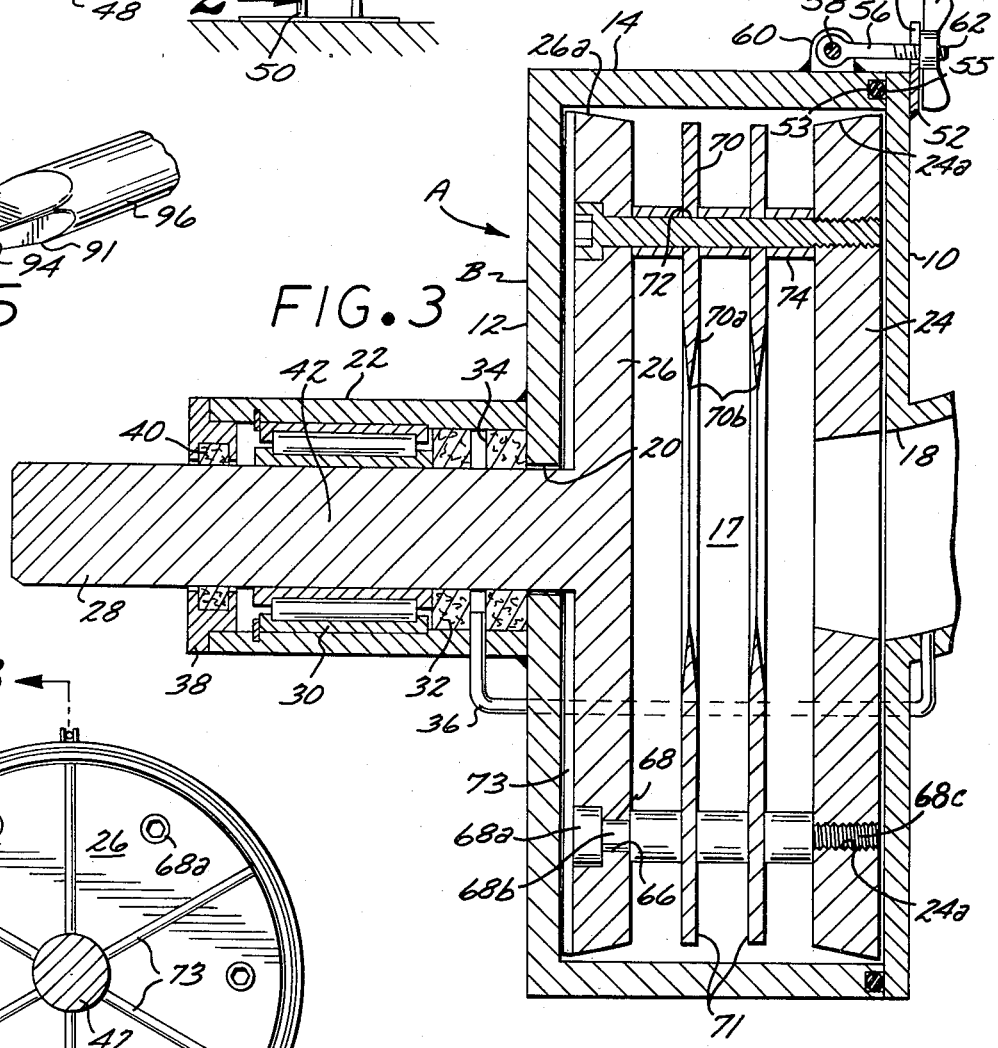
FIG. 3
FIG. 2

CONCRETE PUMP AND METHOD OF USING SAME

BACKGROUND OF THE INVENTION

1. Field of the Invention

Concrete Pump and Method of Using Same.

2. Description of the Prior Art

Prior to the present invention, the most successful pumps used in pumping flowable concrete employed reciprocating pistons and associated valving, with the pistons stopping at the end of each stroke. Thus, concrete moves intermittently through a hose or conduit connected to the discharge of a reciprocating pump. The friction of the flowable concrete in a hose is highest when being accelerated from a rest position to the maximum rate of flow. This intermittent flow makes the discharge of flowable concrete from the hose erratic and difficult to direct into a concrete form.

A major object of the present invention is to provide a method of pumping flowable concrete containing large pieces of aggregate at a substantially constant rate without sharp variations in pressure and in so doing overcome the major operational disadvantages inherent in prior art reciprocating pumps used in pumping concrete.

Another object of the invention is to supply a concrete pump that is compact, requires no valves, is easily cleaned, discharges the concrete at a substantially uniform rate without sharp variations in pressure, and a pump that when it encounters a piece of aggregate will cut the latter into portions that will pass through the pump.

These and other objects and advantages of the present invention will become apparent from the following detailed description of the structure of the concrete pump and method of using the same to transfer flowable concrete to a desired location at a substantially uniform rate and without sharp variations in pressure.

SUMMARY OF THE INVENTION

A vertically extending circular confined space is defined within a housing that has first and second side walls and an end wall. The first side wall has a centered inlet opening therein that is in communication with a hopper having steep downwardly extending walls.

A power driven shaft extends into the confined space through an opening in the second side wall. The shaft rotatably supports a heavy circular plate adjacent the second side wall, with the surface of the plate nearest the second side wall having a number of shallow radially extending ridges thereon.

The circular plate on the outer third portion thereof supports a number of circumferentially spaced bolts that extend towards the first side wall. The bolts on the free ends thereof support another circular plate that has a centered tapered opening therein. The bolts in cooperation with spacers mounted thereon support a number of ring-shaped discs between the two plates in laterally spaced relationship. The spaces between the discs are of sufficient width to permit the majority of the aggregate in the flowable concrete to pass therethrough. The outer peripheries of the two circular plates taper inwardly towards one another.

A rectangular cut water is formed in an outer portion of the end wall and communicate with a diffuser of the same transverse cross-section, but the diffuser also developing into a transverse circular cross-section to serve as a transition. The portion of the diffuser of circular transverse cross-section is connected to the hose or conduit that extends to the desired location.

Flowable concrete is intermittently dumped into the hopper and flows by gravity into the confined space. The rotating plates and ring-shaped discs have boundary layers of the concrete that adhere thereto, with the boundary layers merging into the balance of the concrete in the confined space. The two circular plates and ring-shaped discs as they rotate shear the boundary layers from the concrete in the confined space and in so doing cause the concrete to rotate as a circular body. Due to this rotation, and the centrifugal force imposed thereon, concrete entering the confined space moves in an outwardly directed spiral path, with the aggregate therein passing through the spaces between the ring-shaped discs.

The concrete discharges with stream line flows into the diffuser, and is discharged therefrom at a substantially constant rate and without any sharp variations in pressure into the hose or conduit where it flows therethrough with minimum frictional resistance. The angle of the diffuser is critical, for if it is too great the flowing concrete will separate therefrom and become turbulent in flow with resultant clogging of the diffuser.

Pieces of aggregate entering the confined space that are too large to pass through the spaces between the discs are cut into smaller portions by the rotating knives that will so pass therethrough. The tapered peripheral edges of the two plates serve to roll or direct concrete in the outer portion of the confined space back into the ring shaped discs, and in so doing prevent the build up of aggregate in the confined space that would jam rotation of the plates and ring-shaped discs. The radially extending discs on the plate closest the second side wall act as a pump to direct concrete away from the sealed opening through which the shaft, and minimizes the posibility of this sealed opening, leaking.

BRIEF DESCRIPTION OF THE DRAWINGS

FIG. 1 is a side elevational view of the pump;

FIG. 2 is a transverse cross-sectional view of the pump taken on the line 2—2 of FIG. 1;

FIG. 3 is a cross-sectional view of the pump taken on the line 3—3 of FIG. 2; and FIG. 4 is a fragmentary front elevational view of one of the locks that hold the first side wall in a confined space defining position with the end wall and second side wall.

DESCRIPTION OF THE PREFERRED EMBODIMENT

The concrete pump A as may best be seen in FIGS. 1 and 2 includes a housing B that is defined by a first vertical side wall 10, second side wall 12 that is laterally spaced a substantial distance from the first side wall, and an end wall 14 that extends between the side walls and cooperates therewith to define a circular confined space 17. The first side wall 10 has a tapered centered inlet opening 18 therein.

Second side wall 12 has a centered opening 20 therein from which a cylindrical shell 22 extends outwardly. A first heavy wall circular plate 24 is disposed in confined space 17 adjacent first side wall 10. The confined space 17 has a second heavy wall circular plate 26 disposed therein adjacent second side wall 12. A bearing 30 is mounted in shell 22 and has longitudinally spaced seats 32 situated between it and second side wall 12 in the shell 22. The seals 32 have a space 34 therebetween. A tube 36 extends from space 34 and communicates with opening 18 as shown in FIG. 3. The free open end of shell 22 is closed by an end piece 38 that has a seal 40 therein.

A shaft 42 is rotatably supported by bearing 30 and has a coupling 44 on the outer end thereof that is connected to the drive shaft 46 of a conventional prime mover 48 such as an electric motor or the like. The inner end of shaft 42 is connected to the center of the second circular plate 26. Housing B is mounted on a conventional base 50 as shown in FIG. 1. The first side wall 10 has a number of circumferentially spaced rigid strips 52 extending outwardly therefrom as shown in FIGS. 3 and 4, with each strip having a slot 54 that extends inwardly from the outer end thereof. A number of screws 56 are provided that have eyes on first ends thereof that pivotally engage pins 58 that are supported from the outer surface of end wall 14 by lugs 60. The screws 56 have threaded portions 62 that project outwardly beyond the strips 52 when the screws are positioned in slots 54. The threads 62 are engaged by wing nuts 64. A circumferentially extending groove 53 is formed in an end surface of end wall 14 and supports a resilient ring 55 therein. The resilient ring 55 is in pressure sealing contact with first end wall 10 when the wing nuts 64 are tightened on the screws 56 as shown in FIG. 3. By loosening the wing nuts 64, the screws may be pivoted outwardly and the first side wall 10 removed from the housing B to permit the cleaning of the interior thereof.

A number of circumferentially spaced transverse bores 66 are formed in the outer one third portion of the second circular plate 26 that support bolts 68 that extend towards first plate 24. Each bolt 68 includes a head 68*a*, and a shank 68*b* that has threads 68*c* on the portion thereof closest to first plate 24. Each of the bores 66 includes an enlarged outer portion in which a bolt head 68*a* is disposed in a recessed position as illustrated in FIG. 3. The threads 68*c* engage tappered bores 24*a* formed in the first plate 24 as shown in FIG. 3. A number of ring-shaped discs 70 are provided that have a number of circumferentially spaced transverse bores 72 therein through which the shanks 68*b* of the bolts 68 extend. Each bolt 68 has a number of cylindrical spacers 74 mounted thereon that serve to maintain the ring-shaped discs 70 in laterally spaced relationship to one another and to the first and second plates 24 and 26. The ring shaped discs 70 are separated by spacers 71 of sufficient width to permit the majority of aggregate E in concrete F to pass outwardly therethrough.

The inner peripheral portion of each of the disc shaped members 70 is shaped to define two inwardly extending circular surfaces 70*a* that meet at a sharp apex 70*b* that serves as a circular knife edge. A minor portion of the aggregate E may have pieces E-1 of such magnitude as to not be able to pass outwardly through one of the spaces 71. Due to the centrifugal force exerted on aggregate E-1, it is forced outwardly to contact knife edges 70*b* as shown in phantom line in FIG. 3, and be severed into aggregate particles E that will pass through the spaces 71.

A hopper C is shown in FIG. 1 that intermittently has flowable concrete F dumped therein. The hopper C includes a curved upwardly extending and outwardly tapering delivery conduit 76 that on the upper end develops into upwardly extending, outwardly tapering end walls 78 and 80 and sidewalls. The hopper C is held in a fixed position relative to the pump B by conventional support means (not shown).

A cut water opening 90 is formed in an outer extremity of end wall 14, which cut water is of rectangular transverse cross section. The cut water 90 is in communication with a diverging diffuser 91 that has sidewalls 92 and end walls 94 that provide a transition to a conduit or hose 96 of circular transverse cross section. The side walls 92 and end walls 94 should not taper outwardly relative to the centerline 98 by more than seven degrees, for at an angle greater than this the concrete being discharged tends to separate from the end walls and side walls with the flow then becoming turbulent. Aggregate then may tend to separate from the flowable concrete and build-up in the interior of the diffuser 91 to the extent that flow of concrete therethrough is blocked.

As an illustration of the compactness of the pump A, concrete F having aggregate E up to one and one half inch in size may be pumped using ten inch diameter circular plates 24 and 26, with the diameter of the inner peripheries of the ring-shaped discs being four inches. It has been found from experience that irrespective of the size of the pump, best results are obtained when a ratio of two and one half is maintained between the diameter of the ring-shaped discs 70 and the inner peripheries thereof that define the knife edges 70*b*. For one and one half inch aggregate it has been determined that the cut water should be two inches times four and one half inches and free of sharp edges to prevent the cut water opening being obstructed by aggregate E. The diffuser 91 provides a transition to the hose or conduit 96 having a four inch interior diameter. It will be noted that the hopper C has steep end walls and side walls, and particularly no flat substantially horizontal surface. Flat surfaces will cause the concrete E to bridge and jam the entrance into pump B.

In operation, the concrete E flows by gravity from hopper C into confined space 17 where rotary motion is imparted thereto. The incoming concrete E due to centrifugal force imposed thereon tends to move outwardly in a spiral path and discharge through cut water 90. The movement of concrete E in confined space 17 is stream line with the concrete moving outwardly through the spaces 71 between the ring-shaped discs 70. This stream line flow of concrete E continues through diffuser 91 and hose or conduit 96. Thus it will be seen that the concrete E discharges at a substantially constant rate and without sharp variations in pressure through hose or conduit 96. The flow of concrete E through hose 96 is with a minimum of frictional resistance as there is a constant rather than a pulsating flow as occurs when prior art reciprocating pumps are used.

The tapered circumferential surfaces 24*a* and 26*a* on first and second circular plates 24 and 26 results in concrete E being rolled over and directed into ring-shaped discs 70 and thus substantially precludes the build up of aggregate E between housing B and plates 24 and 26, and ring-shaped discs 70 to the extent that the plates and discs cannot rotate.

What is claimed is:

1. A method of pumping flowable concrete containing aggregate to a desired location at a substantially constant rate and with no sharp variation in pressure, said method comprising the steps of:

a. defining a vertically extending circular confined space by first and second side walls that have an end wall extending therebetween, said first side wall having a centered inlet opening therein and said end wall defining a discharge opening;

b. disposing substantially vertical first and second circular surfaces in said confined space in fixed laterally spaced relationship with a plurality of laterally spaced ring-shaped surfaces situated therebetween, said first and second circular surfaces adjacent said first and second side walls, said first surface having a centered opening therein in communication with said inlet opening, and the inner peripheries of said ring-shaped surfaces formed to define circular knife edges;

c. concurrently rotating said first and second circular surfaces and said ring-shaped surfaces;

d. sequentially discharging said flowable concrete into said confined space through said inlet opening as said first and second circular surfaces and ring-shaped surfaces rotate, with boundary layers of said flowable concrete that adhere to said first and second circular surfaces and ring-shaped surfaces being sheared from the balance of said flowable concrete in said confines space with resultant rotation of said flowable cement in said confined space, said flowable concrete after entering said confined space following an outwardly directed spiral path due to the centrifugal force exerted thereon, and the major portion of said aggregate traveling outwardly through the spaces between said ring-shaped discs, with a minor portion of said aggregate of too great size to pass through said spaces pressure contacting said rotating circular knives to be severed into portions sufficiently small as to pass through said spaces, and said flowable concrete including said major portion of said aggregates and said portions thereof moving in stream line flow through said discharge opening;

e. directing said flowable concrete from said discharge opening into an elongate diverging passage in which the walls defining same are at such an angle relative to said center line of said diverging passage that no separation of said flowable concrete from said walls takes place which would result in turbulent flow and joining of said flowable concrete in said passage;

f. directing the discharge of said flowable concrete from said diverging passage into an elongate circular passage defined by a resilient side wall, with said resilient side wall being subject to a minimum of strain due to said flowable concrete traveling through the same at a substantially constant rate and with no sharp variations in pressure;

g. utilizing the rotation of said second circular surface relative to said flowable concrete in said confined space to generate a longitudinal force on said second circular surface that counteracts the imbalance on said first and second circular surfaces and ring-shaped surfaces due to the flow of said flowable concrete into said confined space;

h. forming the exterior edge surfaces of said first and second surfaces to taper inwardly towards one another to direct flowable concrete in the outer portion of said confined space back into said ring-shaped surfaces and prevent aggregate accumulating between said first and second circular surfaces and said ring-shaped surfaces and said end wall that said first and second circular surfaces and ring shaped surfaces become jammed by said aggregate and cannot rotate.

2. A method of pumping flowable concrete containing aggregate to a desired location at a substantially constant rate and with no sharp variations in pressure, said method comprising the steps of:

a. defining a vertically extending circular confined space of substantial width;

b. power rotating a plurality of laterally spaced, parallel ring-shaped discs in said circular confined space, with the space between said ring-shaped discs sufficiently great to permit the majority of said aggregate to move outwardly therethrough;

c. gravity feeding flowable concrete longitudinally into the center of said ring-shaped discs as they rotate, with the boundary layers of fluid concrete that adhere to said ring-shaped discs being sheared from the balance of said flowable concrete in said confined space, said shearing resulting in said flowable concrete in said confined space rotating with streamline flow as a cylindrical body, and said flowable concrete after entering said confined space due to the centrifugal force exerted thereon flowing outwardly in a spiral path through said spaces between said ring-shaped discs towards the outer limit of said confined space;

d. utilizing the rotary motion of said ring-shaped discs to cut those of said aggregate that are too large to move through said spaces between said ring-shaped discs to portions that will do so;

e. discharging flowable concrete from said confined space through a diverging passage that has the sides thereof at such an angle relative to the center-line of said passage that said flowable concrete does not separate from said sides of said passage and become turbulent with resultant jamming of said flowable concrete in said passage;

f. directing said flowable concrete from said diverging passage into an elongate passage defined by a resilient side wall, with said resilient side wall being subject to minimum stress due to said flowable concrete flowing therethrough at a substantially constant rate and without any sharp variations in pressure; and g. rotating a pair of circular surfaces on opposite sides of said ring-shaped surfaces, said circular surfaces tapering inwardly towards one another, with said tapered surface rolling flowable concrete in the outer portion of said confined space towards said ring-shaped surface and preventing said aggregate building up in the outer portion of said confined space to the extent it will prevent the rotation of said ring-shaped discs.

3. A method as defined in claim 2 which includes the further step of:

g. forming the inner peripheries of said ring-shaped discs as circular knife edges that pressure contact those aggregates of too large size to pass through said spaces and sever said large aggregates into small portions that will so pass therethrough.

4. A method as defined in claim 2 which includes the additional step of:

g. employing the power utilized in rotating said ring-shaped discs to generate a longitudinal force that tends to counteract the longitudinal imbalance on said ring-shaped discs due to said flowable concrete flowing into said confined space.

5. A pump for discharging flowable concrete containing aggregate at a substantially uniform rate and without any sharp variation in pressure to a desired location through a conduit of circular transverse cross-section; said pump being of the type that includes first and second side walls and an end wall that extends therebetween and cooperates therewith to define a circular confined space, said first side wall having a centered inlet opening therein, a power driven shaft that extends into said confined space through a seal defining opening in said second side wall; a rotor assembly in said confined space, said rotor assembly including first and second heavy wall circular plates that are laterally spaced, said first and second plates having outer peripheral edge surfaces, said first plate having a centered opening, said second plate having the center portion thereof connected to said shaft and being adjacently disposed to said second side wall, a plurality of laterally spaced ring-shaped members disposed between said first and second circular plates, said ring-shaped discs having inner and outer peripheries and said ring-shaped discs having lateral spaces therebetween to sufficient magnitude to allow the largest of the major portion of the aggregate to pass outwardly therethrough, said pump being characterized by:

a. said inner peripheries of said ring-shaped discs and said opening in said first circular member being of sufficient diameter to permit the largest of said aggregate to move therethrough with said concrete within which it is entrained, said concrete after it enters said confined space being subjected to rotary action as boundary layers of said concrete on said ring-shaped discs and first and second circular members are sheared from the balance of said concrete in said confined space, with concrete and aggregate entering said confined space flowing outwardly in a spiral path as a result of the centrifugal force imposed thereon by said concrete and aggregate rotating in said confined space;

b. circular knife edges formed on said inner peripheries of said ring-shaped discs that are pressure contacted by pieces of aggregate too large to pass through said lateral spaces between said ring-shaped discs and be severed as a result thereof into portions that will pass through said lateral spaces;

c. first means on said second circular plate for pumping said concrete in said confined space away from said sealed opening to minimize said sealed opening leaking;

d. second means on said outer peripheral surfaces of said first and second plates which as said rotor rotates directs said concrete and aggregate in the outer portion of said confined space inwardly towards said ring-shaped discs to prevent said aggregate building up between said end wall and rotor to the extent the latter will bind in said housing; and e. a diffuser that extends outwardly from a rectangular cut water opening in said end wall of said housing, said cut water opening sufficiently large to permit said aggregate that has passed through said lateral spaces between said ring-shaped discs to discharge therethrough, said diffuser defined by a plurality of outwardly tapering walls, each of which is at an angle of no greater than seven degrees from the center line of said diffuser to prevent separation of said concrete and aggregate from said walls and said concrete and aggregate assumming turbulent flow whereupon said diffuser may become clogged with concrete, and said diffuser on the free end effecting a transition to a cylindrical cross-section that is in communication with said conduit.

6. A pump assembly for discharging flowable concrete containing aggregate through a hose of circular transverse cross section to a desired location at a substantially constant rate and without sharp diviations in pressure, said pump of said assembly being of the type that has a power driven shaft that extends through a seal defining opening in a housing into a confined space to rotate a rotor that includes first and second circular laterally spaced plates that have a plurality of ring-shaped discs situated therebetween that have inner and outer peripheries, with the diameters of said inner peripheries and an inlet in said housing axially aligned therewith being sufficiently large to permit the largest of said aggregate to pass therethrough as said rotor rotates, said assembly including:

a. first means for discharging intermittently deposited flowable concrete and aggregate through said inlet into said confined space by gravity as a continuous flow that will not be interrupted by said flowable concrete and aggregate budging said inlet and clogging same to prevent further flow, said rate of flow being substantially the same at which said flowable concrete and aggregate discharge from said housing;

b. second means on said ring-shaped discs for cutting pieces of aggregate in said confined space too large to pass through said lateral spaces between said ring-shaped discs into portions that will so pass through said lateral spaces;

c. a diffuser that extends outwardly from a rectangular cut water opening in said housing, said cut water opening of sufficient size as to permit said aggregate that has moved through said lateral spaces to discharge therethrough with said flowable concrete, said diffuser of rectangular transverse cross section and defined by a plurality of outwardly tapering walls, with no one of said walls at greater than a seven degree angle with the centerline of said diffuser to prevent separation of said flowable concrete from said walls and the flow of said flowable concrete and aggregate becoming turbulent and aggregate separating from said flowable concrete and blocking the interior of said diffuser, said diffuser on the free end portion thereof providing a transition of circular transverse cross section that is connect to said hose; and d. third means on said first and second circular plate for directing aggregate that may accumulate in the outer portion of said confined space back towards said ring-shaped discs and prevent said aggregate accumulating in said outer portion to the extent it will jam the rotation of said rotor.

7. A pump assembly as defined in claim 6 in which the ratio of the outer and inner peripheries of said ring-shaped discs is substantially five to two.

8. A pump assembly as defined in claim 6 which in addition includes:

d. third means on said rotor for pumping said flowable concrete in said confined space away from said seal defining opening to minimize the possibility of said seal defining opening leaking.

9. A pump for discharging flowable concrete containing aggregate through a tubular conduit at a substantially constant rate and without sharp variations in pressure, said pump being a type that includes a housing defined by first and second laterally spaced side walls, said first side wall having a centered inlet opening therein, said second side wall having a centered seal defining opening therein through which a power driven shaft extends into said confined space; a rotor disposed in said confined space, said rotor including first and second laterally spaced circular plates, said first plate having a centered opening therein said centered opening and said inlet opening of sufficient diameter to allow the largest of said aggregate to pass therethrough, said first and second circular plates having outer peripheral edge surfaces, a plurality of laterally spaced circular discs that have inner and outer peripheries, said inner peripheries sufficiently large to permit the largest of said aggregate to pass therethrough, with the lateral spacing between said ring-shaped discs sufficiently large as to permit the largest of the major portion of said aggregate to pass therethrough, said second circular plate having the center thereof connected to said power driven shaft, and first means for holding said first circular plate and ring-shaped discs in fixed lateral spacing relative to said second circular plate, said pump being characterized by including:

a. second means for discharging said flowable concrete and aggregate by gravity from a position into which it is intermittently deposited into said confined space through said inlet as a steady flow that will not bridge said inlet and become clogged therein, with said flowable concrete and aggregate upon entering said confined space rotating outwardly in a spiral path as boundary layers of said flowable concrete that adhere to said ring-shaped discs and first and second circular plates are sheared from said flowable concrete in said confined space, with the rate at which said flowable concrete flows into said confined space being related to the rate at which said flowable concrete and aggregate discharges therefrom;

b. third means operatively associated with said rotor for cutting aggregate too large to pass through said lateral spaces between said discs into portions that will so pass therethrough;

c. fourth means on said first and second plates that tend to direct flowable concrete in the outer portion of said confined space between said rotor and housing inwardly towards said ring-shaped discs to prevent said aggregate building up between said rotor and housing to the extent said rotor will bind in said housing and no longer rotate; and d. an elongate diffuser that extends outwardly from a rectangular cut water opening in said end wall, said cut water opening of sufficient size as to permit all of said aggregate that has passed through said lateral spacings to discharge therethrough, said diffuser being defined by a plurality of outwardly tapering walls that continue to define a passage of rectangular transverse cross-section, each of said walls at not greater than a seven degree angle with the centerline of said diffuser, and said diffuser on the free end thereof developing into a transition portion of circular transverse cross-section to which said conduit is connected.

10. A pump as defined in claim 9 in which said second means is an open top hopper that includes a plurality of steep side walls that taper inwardly and at the lower portions thereof effect a transition into an inwardly tapering conduit that is in communication with said inlet.

11. A pump as defined in claim 9 which in addition includes:

e. fastening means for removably securing said first side wall to said end wall to permit access to said confined space and permit cleaning of the latter after a pumping operation is completed.

12. A pump as defined in claim 9 in which said third means are circular knives defined on the inner peripheries of said ring-shaped discs.

13. A pump as defined in claim 9 in which said fourth means are inwardly tapering edge surfaces on the outer peripheries of said first and second circular plates.

* * * * *